US007997051B2

(12) United States Patent
Biondi et al.

(10) Patent No.: US 7,997,051 B2
(45) Date of Patent: Aug. 16, 2011

(54) METHOD OF FOLDING A SHEET OF PACKING MATERIAL ABOUT A GROUP OF CIGARETTES

(75) Inventors: Andrea Biondi, Bologna (IT); Ivanoe Bertuzzi, Casalecchio di Reno (IT); Roberto Polloni, Modigliana (IT)

(73) Assignee: G.D Societa' per Azioni, Bologna (IT)

( * ) Notice: Subject to any disclaimer, the term of this patent is extended or adjusted under 35 U.S.C. 154(b) by 127 days.

(21) Appl. No.: 12/300,085

(22) PCT Filed: May 8, 2007

(86) PCT No.: PCT/EP2007/054459

§ 371 (c)(1),
(2), (4) Date: Apr. 17, 2009

(87) PCT Pub. No.: WO2007/128822

PCT Pub. Date: Nov. 15, 2007

(65) Prior Publication Data

US 2009/0320414 A1 Dec. 31, 2009

(30) Foreign Application Priority Data

May 9, 2006 (IT) ..... BO2006A0348

(51) Int. Cl.
*B65B 11/00* (2006.01)

(52) U.S. Cl. ..... 53/466; 53/461; 53/228

(58) Field of Classification Search ..... 53/466, 53/461, 228, 229, 230, 231, 232
See application file for complete search history.

(56) References Cited

U.S. PATENT DOCUMENTS 1,295,461 A 2/1919 De Escobales
(Continued)

FOREIGN PATENT DOCUMENTS

DE 19831621 1/2000
(Continued)

OTHER PUBLICATIONS

International Search Report for counterpart International Application No. PCT/EP2007/054459, dated Aug. 29, 2007.

(Continued)

*Primary Examiner* — Sameh H. Tawfik
(74) *Attorney, Agent, or Firm* — Marshall, Gerstein & Borun LLP

(57) ABSTRACT

A method of folding a sheet (2) of packing material about a group (3) of cigarettes; the method includes the steps of: bringing a first end wall (8*a*) of the group (3) of cigarettes into contact with the flat sheet (2) of packing material, so that the major transverse edges (10) of the group (3) of cigarettes are parallel to the long sides of the sheet (2) of packing material; folding the sheet (2) of packing material into a U about the major transverse edges (10) of the first end wall (8*a*), so that the sheet (2) of packing material partly covers both the major lateral walls (6) of the group (3) of cigarettes; folding the sheet (2) of packing material about the minor transverse edges (10) of the first end wall (8*a*), so that the sheet (2) of packing material completely covers both the major lateral walls (6) and the minor lateral walls (7), and forms a tubular package having one open end at a second end wall (8*b*); and folding the sheet (2) of packing material onto the second end wall (8*b*) to complete the folding of the sheet (2) of packing material about the group (3) of cigarettes.

6 Claims, 18 Drawing Sheets

U.S. PATENT DOCUMENTS

| | | | | |
|---|---|---|---|---|
| 2,196,910 | A * | 4/1940 | Delamere | 53/223 |
| 2,268,926 | A | 1/1942 | Cornock | |
| 3,378,187 | A | 4/1968 | Sherrill et al. | |
| 5,701,725 | A * | 12/1997 | Neri et al. | 53/466 |
| 5,957,280 | A | 9/1999 | Focke et al. | |
| 6,557,699 | B1 | 5/2003 | Focke et al. | |
| 6,854,243 | B2 * | 2/2005 | Sendo et al. | 53/234 |
| 6,935,091 | B2 * | 8/2005 | Gamberini | 53/466 |
| 7,131,246 | B2 * | 11/2006 | Dall'Omo et al. | 53/376.7 |
| 7,360,347 | B2 * | 4/2008 | Lanzarini et al. | 53/463 |
| 7,827,769 | B2 * | 11/2010 | Bertuzzi et al. | 53/466 |

FOREIGN PATENT DOCUMENTS

| | | |
|---|---|---|
| EP | 1533230 | 5/2005 |
| GB | 785076 | 10/1957 |
| GB | 785735 | 11/1957 |
| WO | WO 2004/063031 | 7/2004 |

OTHER PUBLICATIONS

International Preliminary Report on Patentability for counterpart International Application No. PCT/EP2007/054459, dated Apr. 29, 2008.

* cited by examiner

METHOD OF FOLDING A SHEET OF PACKING MATERIAL ABOUT A GROUP OF CIGARETTES

CROSS-REFERENCE TO RELATED APPLICATIONS

This is the U.S. national phase application of International Application No. PCT/EP2007/054459, filed May 8, 2007 which claims the benefit of Italian patent application No. BO2006A.

TECHNICAL FIELD

The present invention relates to a method of folding a sheet of packing material about a group of cigarettes.

The present invention may be used to particular advantage for folding a sheet of foil packing material about a group of cigarettes in the manufacture of a rigid, hinged-lid packet, to which the following description refers purely by way of example.

BACKGROUND ART

In a rigid, hinged-lid packet of cigarettes, the group of cigarettes is wrapped in a sheet of foil inner packing material, on which no glue is applied; a sheet of rigid outer packing material, to which glue is applied, is folded about the sheet of inner packing material; and the sheet of outer packing material is wrapped in a waterproof overwrapping comprising a sheet of transparent plastic packing material, which is heat sealed.

The sheet of foil inner packing material is always in the form of an elongated rectangle, and is first folded into a U about the group of cigarettes; depending on the design of the packing machine used to produce the packet of cigarettes, the sheet of inner packing material may first be folded into a U about the group of cigarettes either crosswise or longitudinally with respect to the cigarettes.

One example of folding a sheet of packing material about a group of cigarettes is described in Patent GB 785076.

The sheet of foil inner packing material has a tear-off top portion defined by a tear-off line, and which, when the packet of cigarettes is first opened, is torn off to permit easy access to the cigarettes. The tear-off line defining the tear-off top portion is normally straight, and is formed on a packing machine by means of a special rotary cutter.

When the lid only covers a lateral portion of the packet (as described, for example, in U.S. Pat. No. 5,957,280) and the sheet of inner packing material is first folded into a U about the group of cigarettes longitudinally with respect to the cigarettes, the tear-off line defining the tear-off top portion may be so complicated in shape as to be difficult to produce on the machine.

DISCLOSURE OF INVENTION

It is an object of the present invention to provide a method of folding a sheet of packing material about a group of cigarettes, designed to eliminate the aforementioned drawbacks, and which at the same time is cheap and easy to implement.

According to the present invention, there is provided a method of folding a sheet of packing material about a group of cigarettes, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
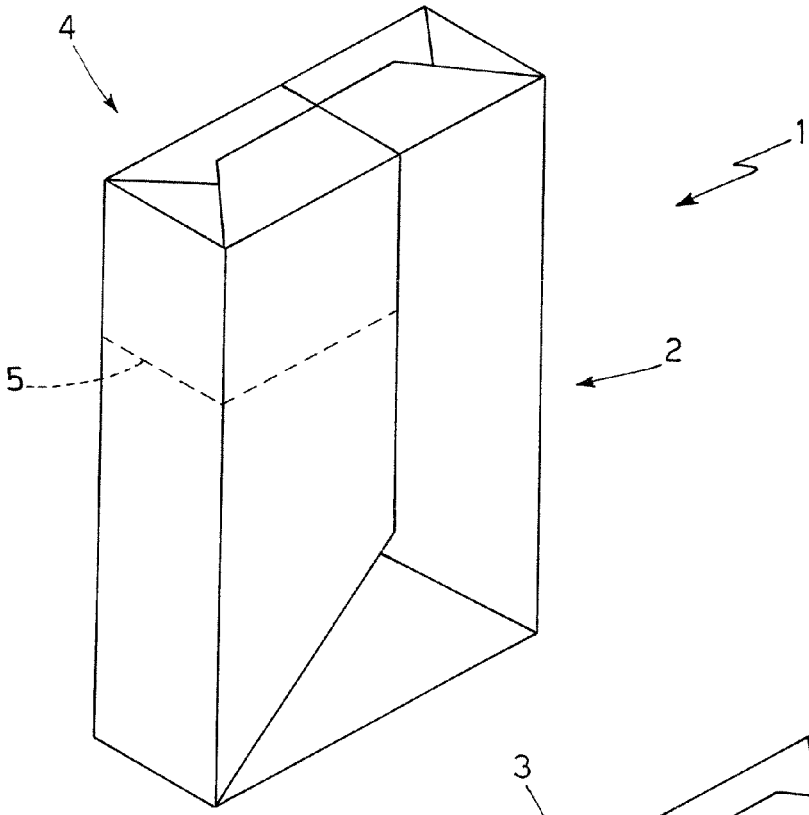
FIG. 1 shows a view in perspective of a first group of cigarettes wrapped in a first sheet of foil packing material folded using the method according to the present invention.
Figure 2:
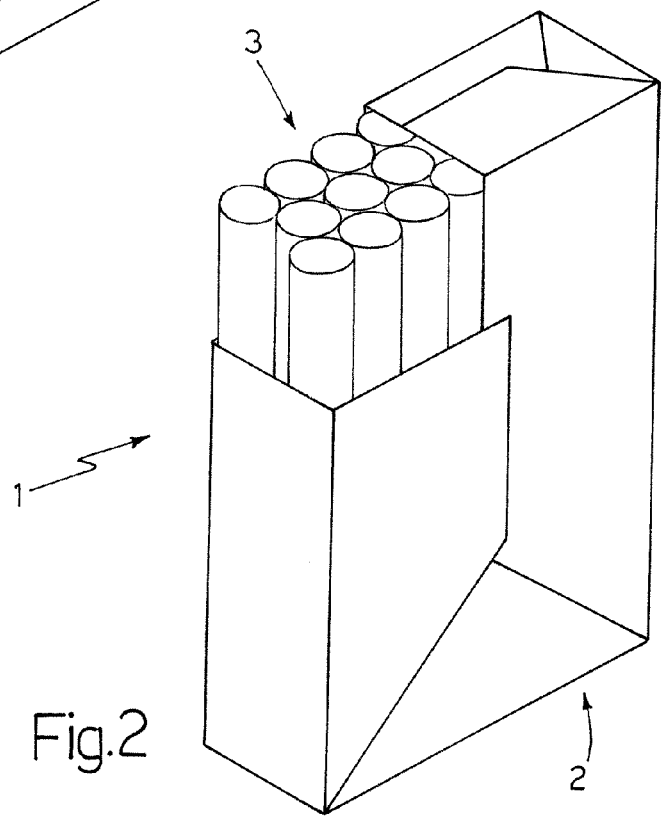
FIG. 2 shows a view in perspective of the first group of cigarettes in FIG. 1, with a tear-off top portion of the first sheet of foil packing material removed.

Number 1 in FIG. 1 indicates as a whole a package defined by a sheet 2 of foil packing material folded about an orderly group 3 of cigarettes (FIG. 2) in the form of a rectangular-section parallelepiped. Package 1 comprises a tear-off top portion 4 defined by a tear-off line 5, and which, when package 1 is first opened, is torn off to permit easy access to group 3 of cigarettes.

Figure 3:
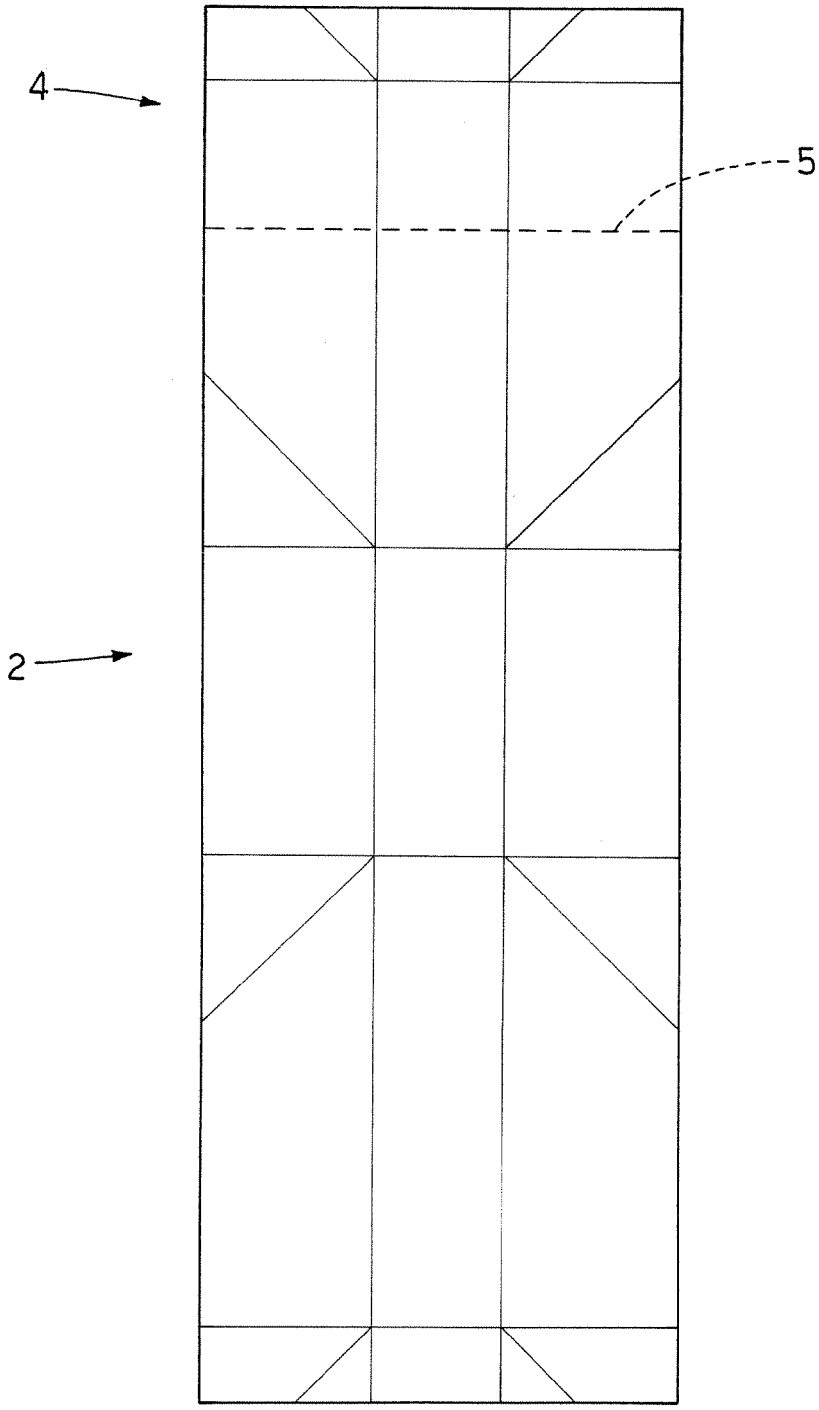
FIG. 3 shows a spread-out plan view of the first sheet of foil packing material and relative fold lines.

As shown in FIG. 3, sheet 2 of packing material is in the form of an elongated rectangle, and comprises two parallel opposite long sides, and two parallel opposite short sides.

Figure 4:
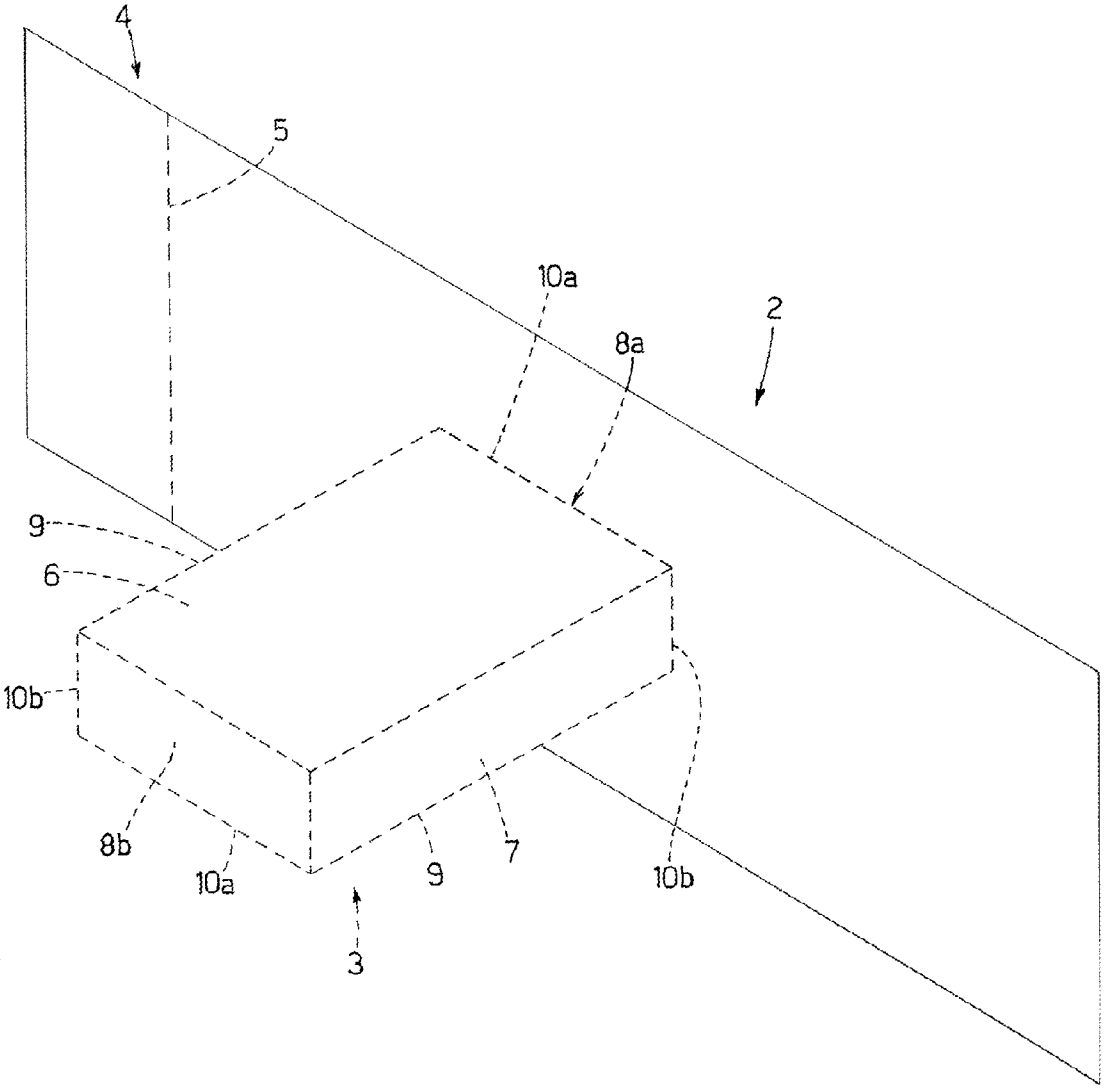
FIGS. 4-8 show schematic views in perspective of successive steps in the folding of the first sheet of foil packing material about the first group of cigarettes.

As shown in FIG. 4, group 3 of cigarettes is substantially in the form of a rectangular-section parallelepiped, and comprises two parallel, opposite, rectangular major lateral walls 6 (only one shown in FIG. 4) defined by the cylindrical lateral walls of the cigarettes; two parallel, opposite, rectangular minor lateral walls 7 (only one shown in FIG. 4) defined by the cylindrical lateral walls of the cigarettes and smaller than major lateral walls 6; and two parallel, opposite, rectangular end walls 8 (only one shown in FIG. 4) defined by the flat ends of the cigarettes. Four longitudinal edges 9 are defined between the two major lateral walls 6 and the two minor lateral walls 7; four major transverse edges 10*a* are defined between the two major lateral walls 6 and the two end walls 8; and four minor transverse edges 10*b* are defined between the two minor lateral walls 7 and the two end walls 8.

The way in which sheet 2 of packing material is folded about group 3 of cigarettes to form package 1 in FIG. 1 will now be described with particular reference to FIGS. 4-8.

Firstly, as shown in FIG. 4, a first end wall 8*a* of group 3 of cigarettes is brought into contact with the flat sheet 2 of packing material, so that major transverse edges 10*a* of group 3 of cigarettes are parallel to the long sides of sheet 2 of packing material, and minor transverse edges 10*b* of group 3 of cigarettes are parallel to the short sides of sheet 2 of packing material. First end wall 8*a* of group 3 of cigarettes is preferably positioned symmetrically in the centre of sheet 2 of packing material with respect to both the long sides and short sides of sheet 2 of packing material.

Figure 5:
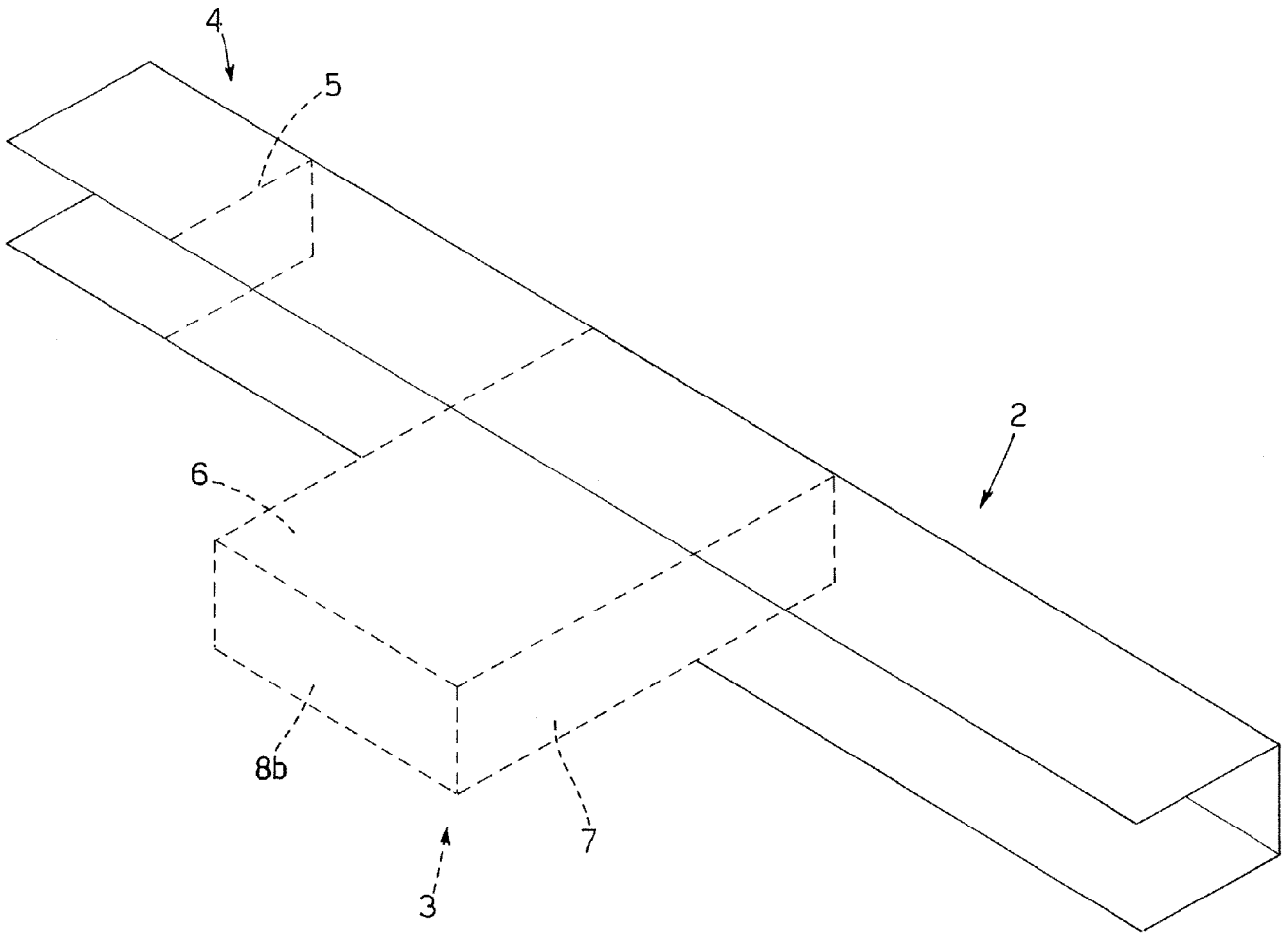

Next, as shown in FIG. 5, sheet 2 of packing material is folded into a U about the major transverse edges 10*a* of first end wall 8*a*, so that sheet 2 of packing material partly covers both the major lateral walls 6.

Figure 7:
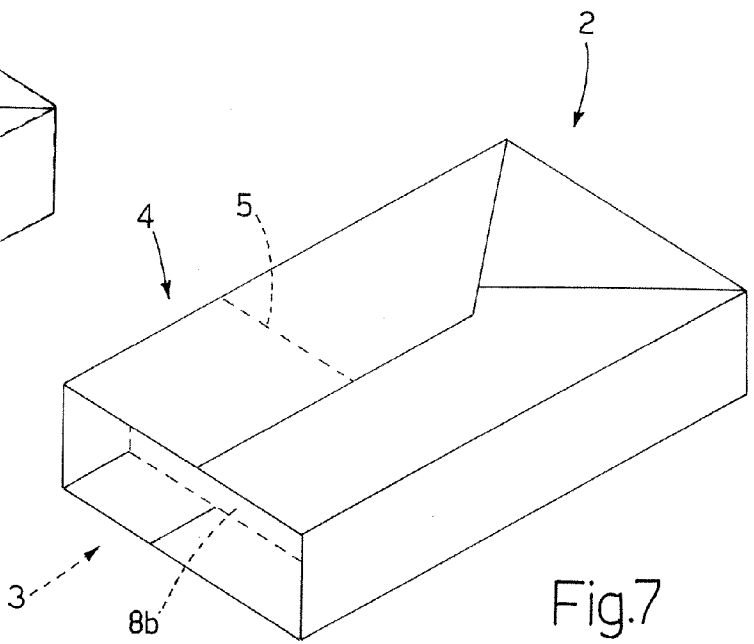
Figure 6:
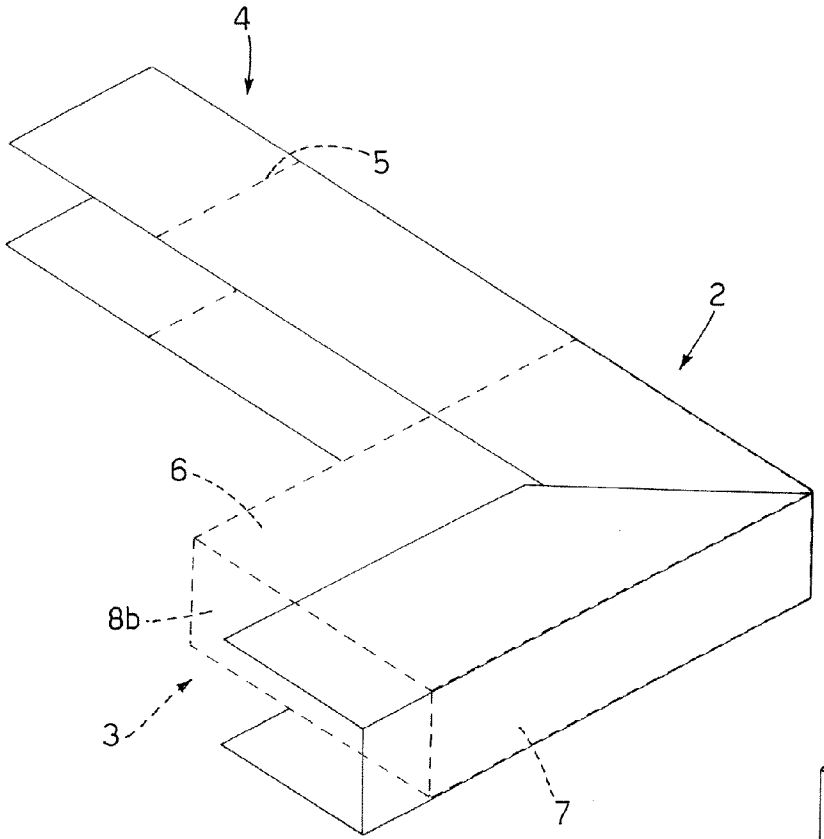

At this point, as shown in FIGS. 6 and 7, sheet 2 of packing material is folded about the minor transverse edges 10*b* of first end wall 8*a*, so that sheet 2 of packing material covers the whole of both major lateral walls 6 and minor lateral walls 7, and forms a tubular package having one open end at a second end wall 8*b* opposite first end wall 8*a*. It is important to note that, at this stage, sheet 2 of packing material forms two Z-shaped folds, which locally impart a triangular shape to sheet 2 of packing material, are partly superimposed, and are located close to first end wall 8*a*.

Figure 8:
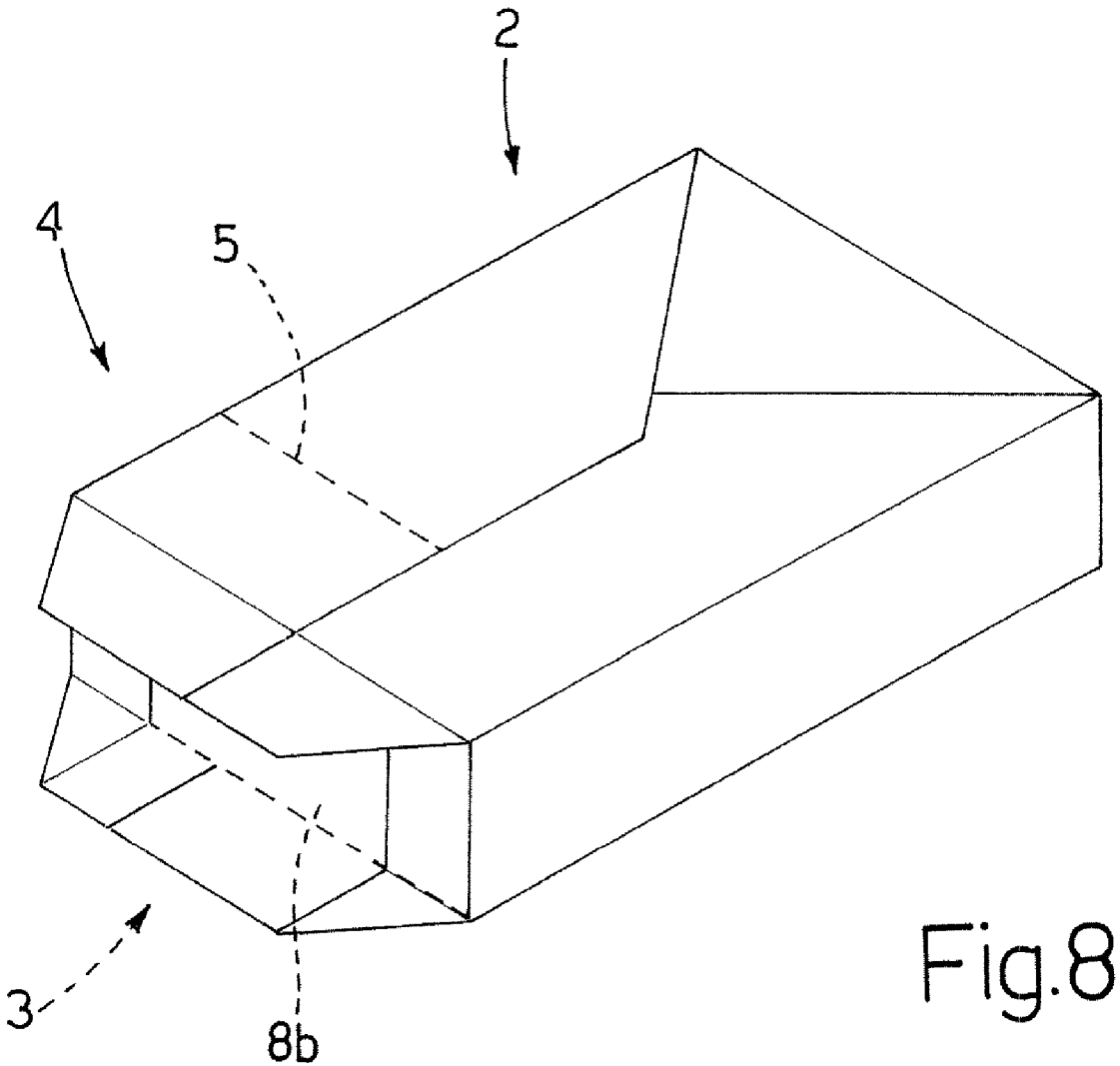

Finally, as shown in FIG. 8, sheet 2 of packing material is folded onto second end wall 8*b* to complete the folding of sheet 2 of packing material about group 3 of cigarettes and so form package 1. More specifically, the step of folding sheet 2 of packing material onto second end wall 8*b* comprises folding sheet 2 of packing material about the two minor transverse edges 10*b* of second end wall 8*b*(FIG. 8), and then folding sheet 2 of packing material about the two major transverse edges 10*a* of second end wall 8*b*.

As shown in the attached drawings, sheet 2 of packing material has only one tear-off line 5, which is parallel and close to a short side of sheet 2 of packing material, and defines tear-off top portion 4. Consequently, tear-off top portion 4 only applies to part of the top end of package 1, as shown clearly in FIGS. 1 and 2. This embodiment is particularly suitable for a rigid packet with a hinged lid covering only a lateral portion of the rigid packet (as described, for example, in U.S. Pat. No. 5,957,280).

In a different embodiment, not shown, sheet 2 of packing material has two tear-off lines 5, each parallel and close to a short side of sheet 2 of packing material and defining tear-off top portion 4, which therefore applies to the whole top end of package 1. This embodiment is particularly suitable for a rigid packet with a hinged lid covering a whole top portion of the rigid packet. In another embodiment, not shown, sheet 2 of packing material has two tear-off lines 5, each of which is parallel and close to a short side of sheet 2 of packing material, is shorter than the short side of sheet 2 of packing material, and defines tear-off top portion 4.

Figure 9:
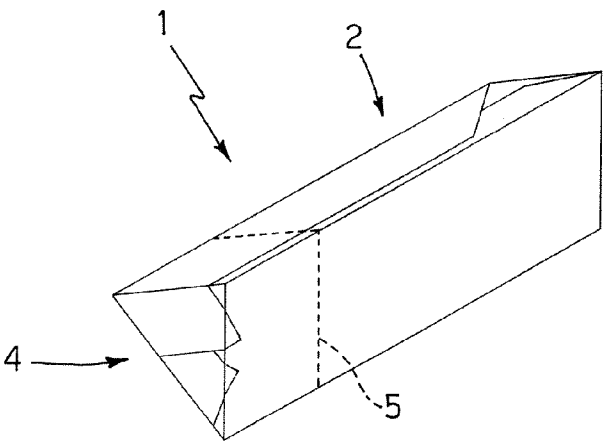
FIG. 9 shows a view in perspective of a second group of cigarettes wrapped in a second sheet of foil packing material folded using the method according to the present invention.

Number 1 in FIG. 9 indicates as a whole a package defined by a sheet 2 of foil packing material folded about an orderly group 3 of cigarettes (FIG. 10) in the form of a parallelepiped with an equilateral triangular cross section. Package 1 comprises a tear-off top portion 4 defined by a tear-off line 5, and which, when package 1 is first opened, is torn off to permit easy access to group 3 of cigarettes.

Figure 11:
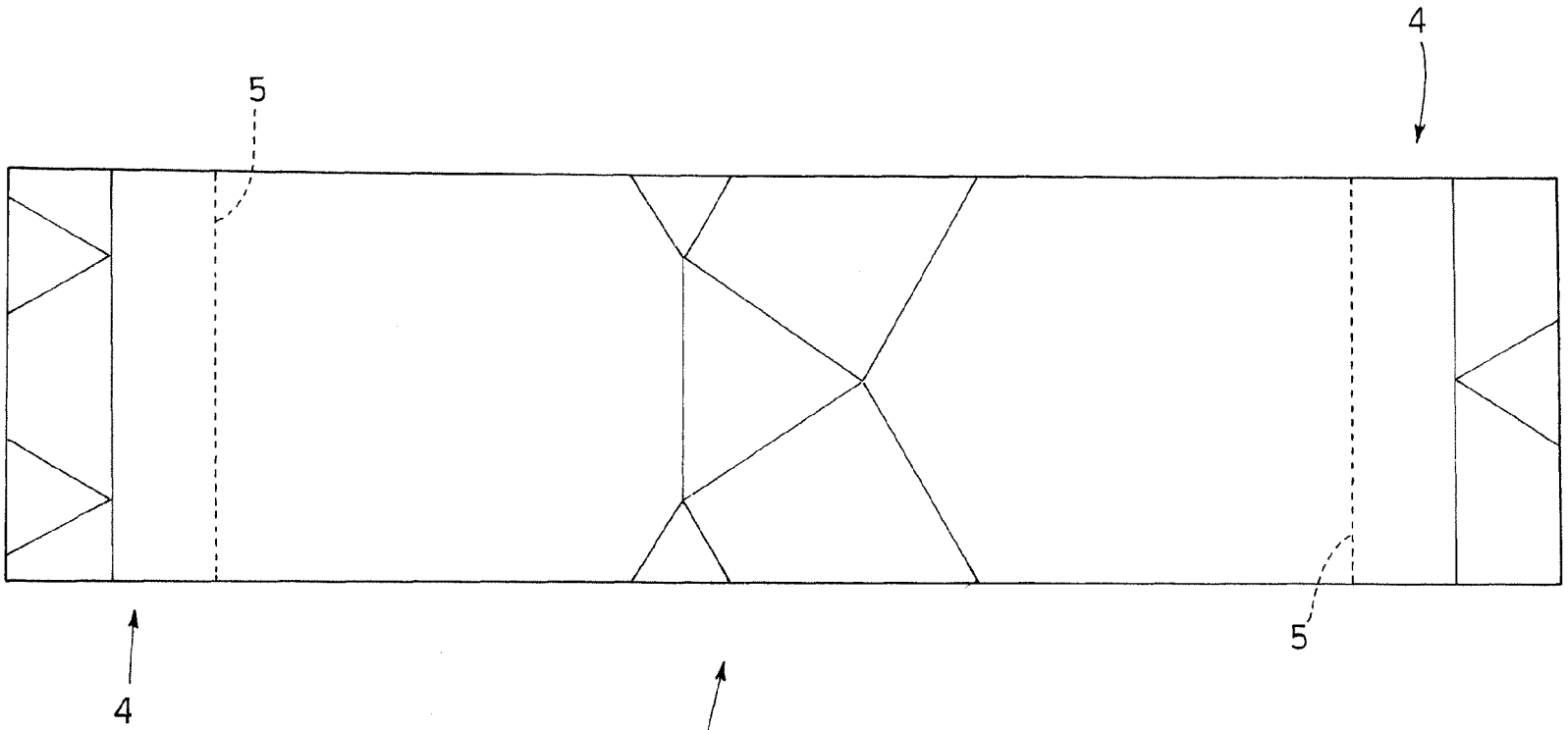
FIG. 11 shows a spread-out plan view of the second sheet of foil packing material and relative fold lines.

As shown in FIG. 11, sheet 2 of packing material is in the form of an elongated rectangle, and comprises two parallel opposite long sides, and two parallel opposite short sides.

Figure 12:
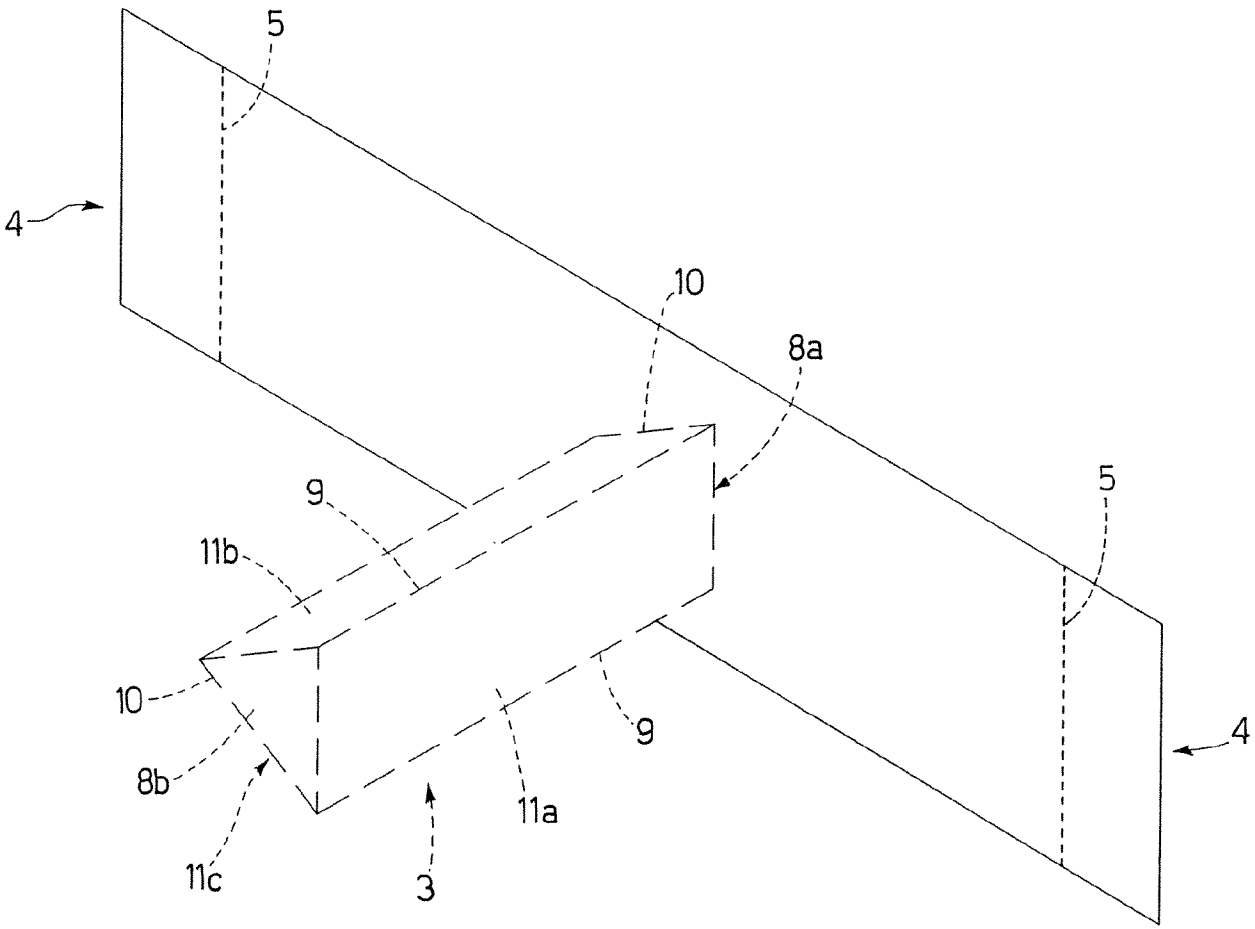

As shown in FIG. 12, group 3 of cigarettes is substantially parallelepiped-shaped with a triangular cross section, and comprises three rectangular lateral walls 11 (only two shown in FIG. 12) defined by the cylindrical lateral walls of the cigarettes; and two parallel, opposite, triangular end walls 8 (only one shown in FIG. 12) defined by the flat ends of the cigarettes. Three longitudinal edges 9 are defined between lateral walls 11; and six transverse edges 10 are defined between lateral walls 11 and the two end walls 8.

The way in which sheet 2 of packing material is folded about group 3 of cigarettes to form package 1 in FIG. 9 will now be described with particular reference to FIGS. 12-15.

Firstly, as shown in FIG. 12, a first end wall 8*a* of group 3 of cigarettes is brought into contact with the flat sheet 2 of packing material, so that a first lateral wall 11*a* of group 3 of cigarettes is perpendicular to the long sides of sheet 2 of packing material and parallel to the short sides of sheet 2 of packing material, and, consequently, a second lateral wall 11*b* and a third lateral wall 11*c* of group 3 of cigarettes slope with respect to the long sides and short sides of sheet 2 of packing material. First end wall 8*a* of group 3 of cigarettes is preferably positioned symmetrically in the centre of sheet 2 of packing material with respect to both the long sides and short sides of sheet 2 of packing material.

Figure 13:
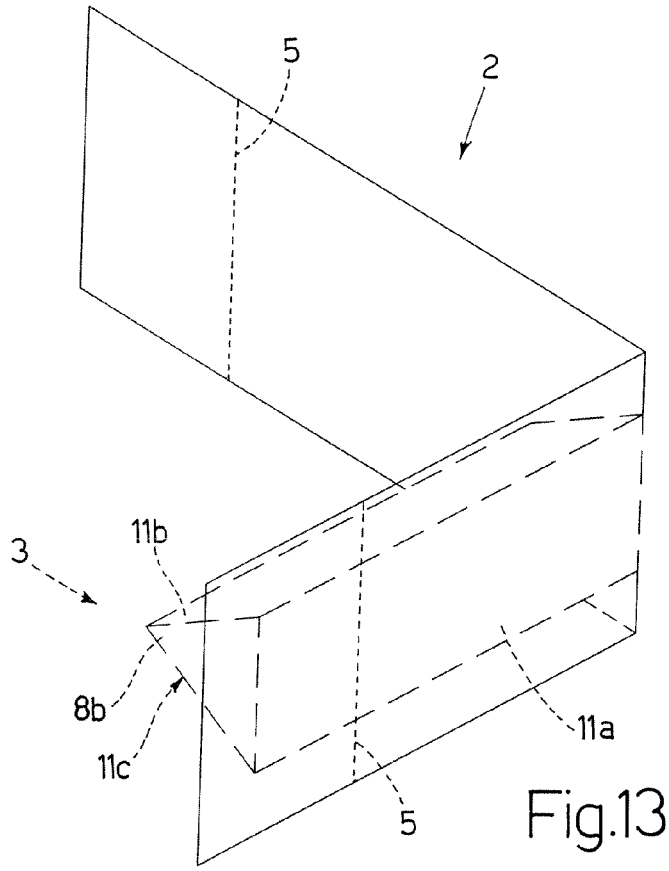

Next, as shown in FIG. 13, a first portion of sheet 2 of packing material is folded onto first lateral wall 11*a*.

Figure 14:
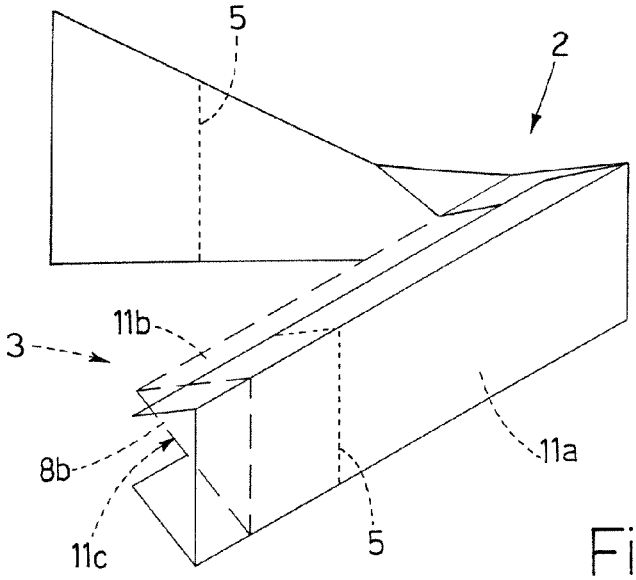

At this point, as shown in FIG. 14, the ends of the first portion of sheet 2 of packing material projecting from first lateral wall 11*a* are folded onto second lateral wall 11*b* and third lateral wall 11*c*; and, as shown in FIG. 14, a second portion of sheet 2 of packing material, opposite the first portion, is then folded onto second lateral wall 11*b* and third lateral wall 11*c*, and partly onto the previously folded first portion of sheet 2 of packing material to form a tubular package having one open end at a second end wall 8*b*.

Figure 15:
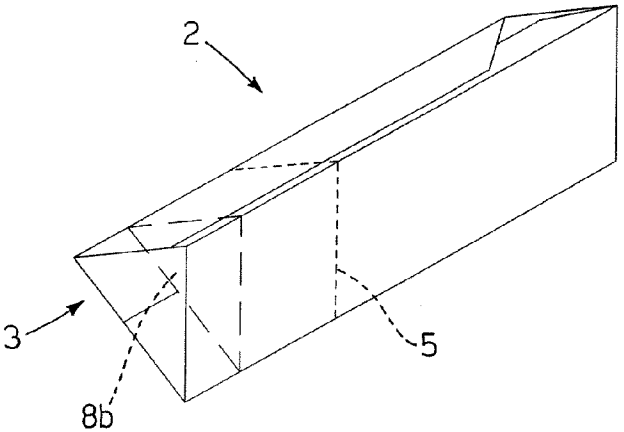
FIGS. 12-15 show schematic views in perspective of successive steps in the folding of the second sheet of foil packing material about the second group of cigarettes.

Finally, as shown in FIG. 15, sheet 2 of packing material is folded onto second end wall 8*b* to complete the folding of sheet 2 of packing material about group 3 of cigarettes and so form package 1. More specifically, the step of folding sheet 2 of packing material onto second end wall 8*b* comprises folding sheet 2 of packing material successively about the three transverse edges 10 of second end wall 8*b*.

Figure 10:
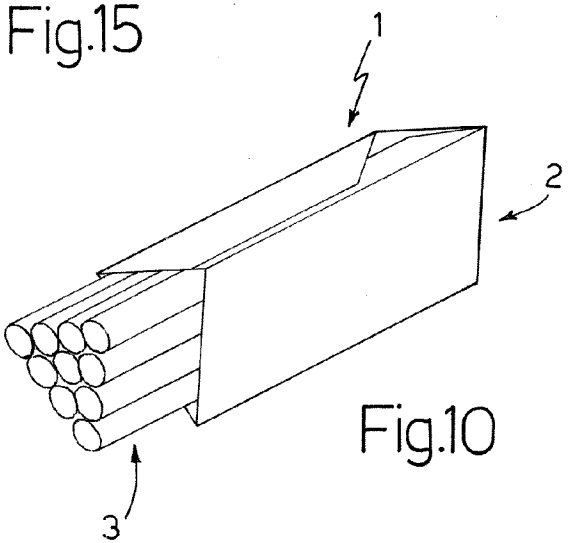
FIG. 10 shows a view in perspective of the second group of cigarettes in FIG. 9, with a tear-off top portion of the second sheet of foil packing material removed.

As shown in the attached drawings, sheet 2 of packing material has two tear-off lines 5, each parallel and close to a short side of sheet 2 of packing material and defining tear-off top portion 4, which therefore applies to the whole top end of package 1, as shown clearly in FIGS. 9 and 10. This embodiment is particularly suitable for a rigid packet with a hinged lid covering a whole top portion of the rigid packet. In another embodiment, not shown, sheet 2 of packing material has two tear-off lines 5, each of which is parallel and close to a short side of sheet 2 of packing material, is shorter than the short side of sheet 2 of packing material, and defines tear-off top portion 4.

In a different embodiment, not shown, sheet 2 of packing material has only one tear-off line 5, which is parallel and close to a short side of sheet 2 of packing material, and defines tear-off top portion 4. Consequently, tear-off top portion 4 only applies to part of the top end of package 1. This embodiment is particularly suitable for a rigid packet with a hinged lid covering only a lateral portion of the rigid packet (as described, for example, in U.S. Pat. No. 5,957,280).

Figure 22:
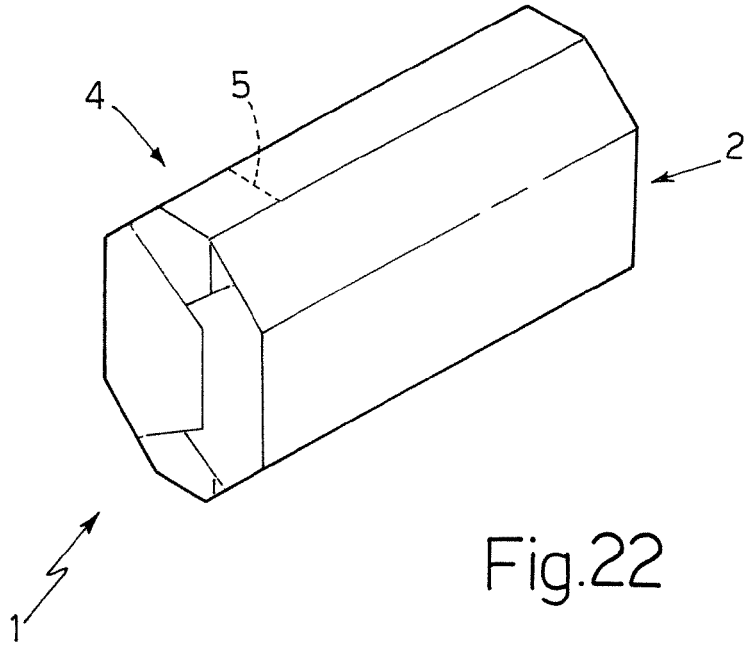
FIG. 22 shows a view in perspective of a third group of cigarettes wrapped in a third sheet of foil packing material folded using the method according to the present invention.

Number 1 in FIG. 22 indicates as a whole a package defined by a sheet 2 of foil packing material folded about an orderly group 3 of cigarettes (FIG. 16) in the form of a parallelepiped with a non-equilateral octagonal cross section (i.e. in which not all the sides of the octagon are equal). Package 1 comprises a tear-off top portion 4 defined by a tear-off line 5, and which, when package 1 is first opened, is torn off to permit easy access to group 3 of cigarettes.

Figure 16:
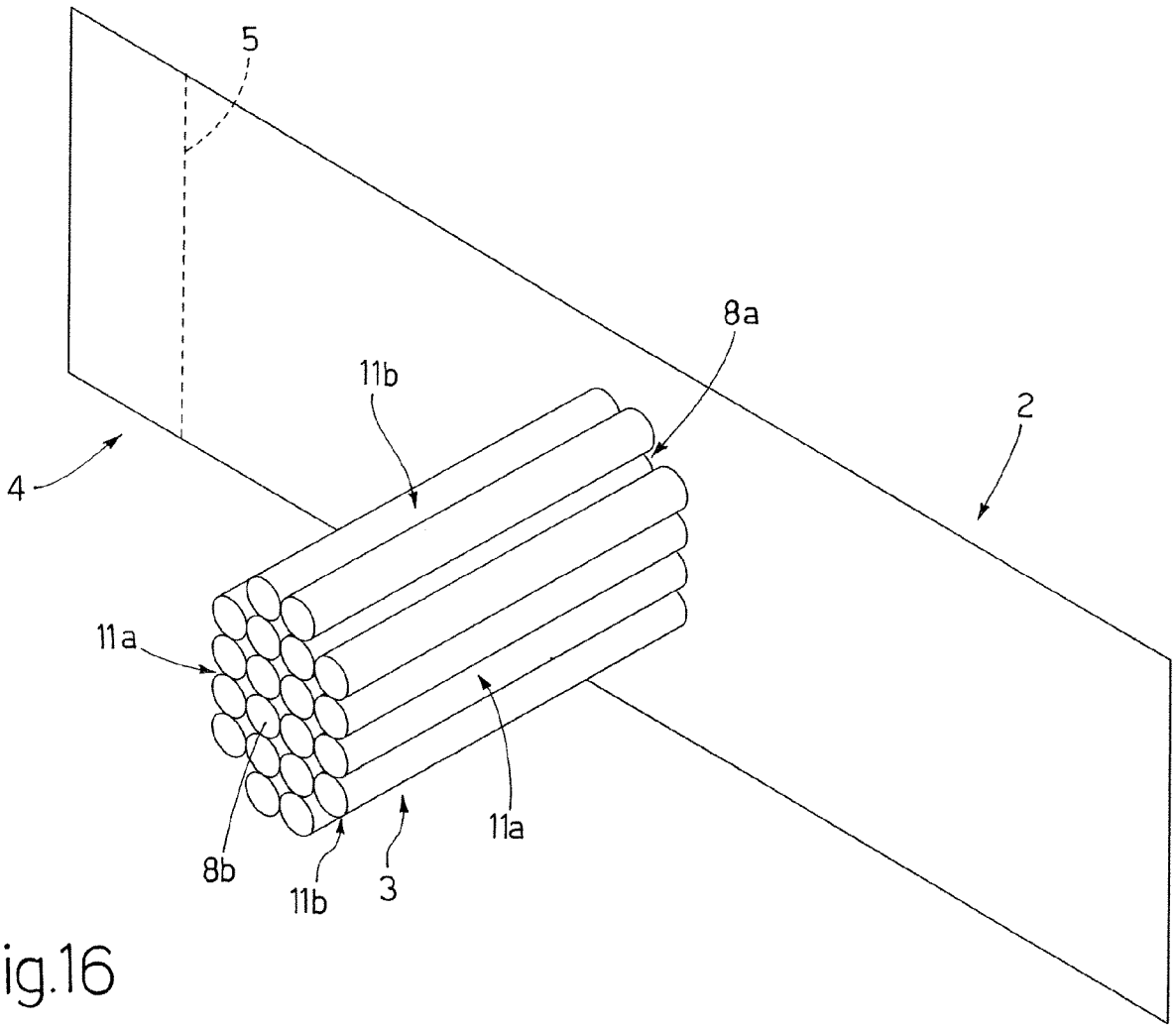
FIGS. 16-21 show schematic views in perspective of successive steps in the folding of the third sheet of foil packing material about the third group of cigarettes.

As shown in FIG. 16, sheet 2 of packing material is in the form of an elongated rectangle, and comprises two parallel opposite long sides, and two parallel opposite short sides.

As shown in FIG. 16, group 3 of cigarettes is substantially in the form of an octagonal-section parallelepiped, and comprises eight rectangular lateral walls 11 (only three shown in FIG. 16) defined by the cylindrical lateral walls of the cigarettes; and two parallel, opposite, octagonal end walls 8 (only one shown in FIG. 16) defined by the flat ends of the cigarettes. Eight longitudinal edges are defined between the eight lateral walls 11; and sixteen transverse edges are defined between the eight lateral walls 11 and the two end walls 8.

The way in which sheet 2 of packing material is folded about group 3 of cigarettes to form package 1 in FIG. 22 will now be described with particular reference to FIGS. 16-21.

Firstly, as shown in FIG. 16, a first end wall 8*a* of group 3 of cigarettes is brought into contact with the flat sheet 2 of packing material, and is preferably positioned symmetrically in the centre of sheet 2 of packing material with respect to both the long sides and short sides of sheet 2 of packing material.

Figure 17:
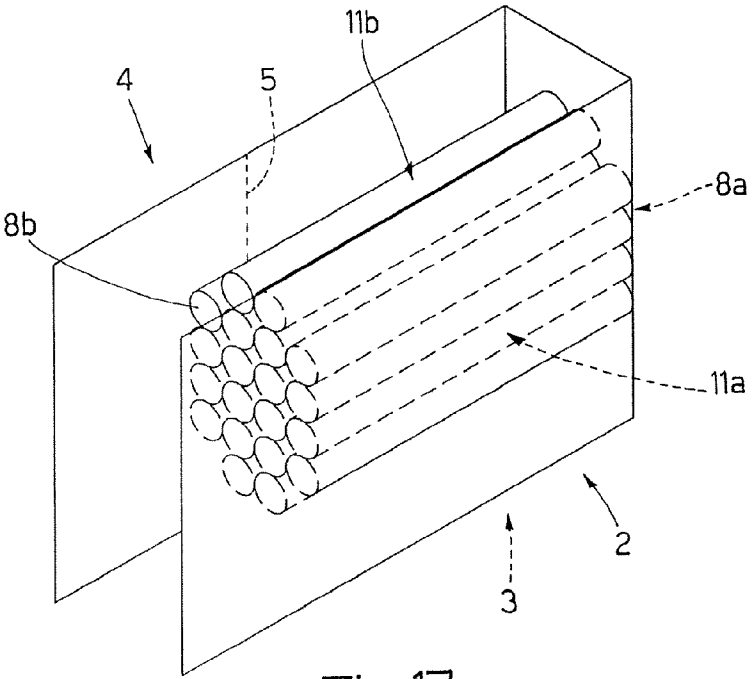

Next, as shown in FIG. 17, sheet 2 of packing material is folded into a U about group 3 of cigarettes by folding two opposite portions of sheet 2 of packing material onto two parallel opposite first lateral walls 11*a* of group 3 of cigarettes.

Figure 18:
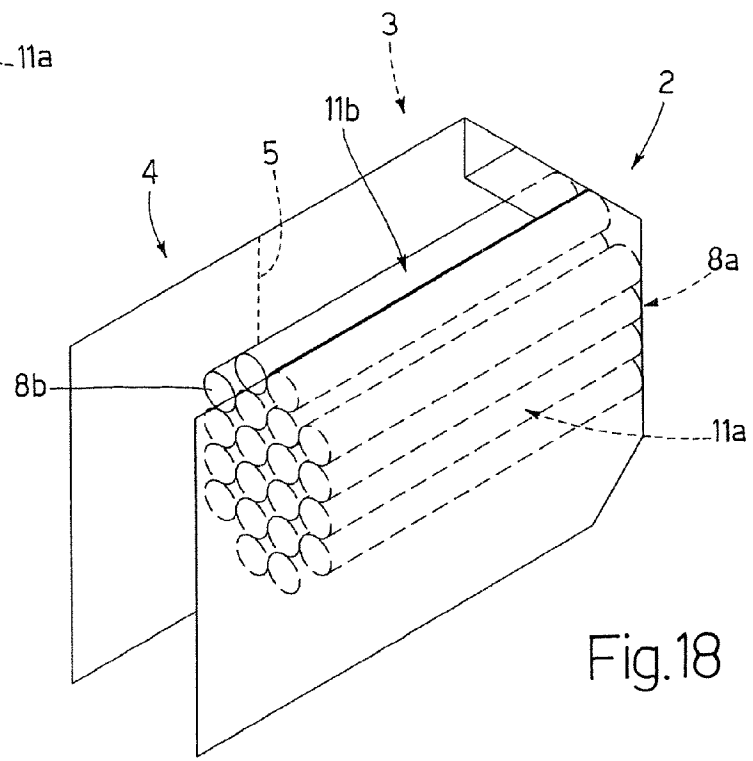

At this point, as shown in FIG. 18, the ends of sheet 2 of packing material projecting from first end wall 8*a* of group 3 of cigarettes are folded onto two parallel opposite second lateral walls 11*b*, perpendicular to first lateral walls 11*a*, of group 3 of cigarettes.

Figures 19, 20:
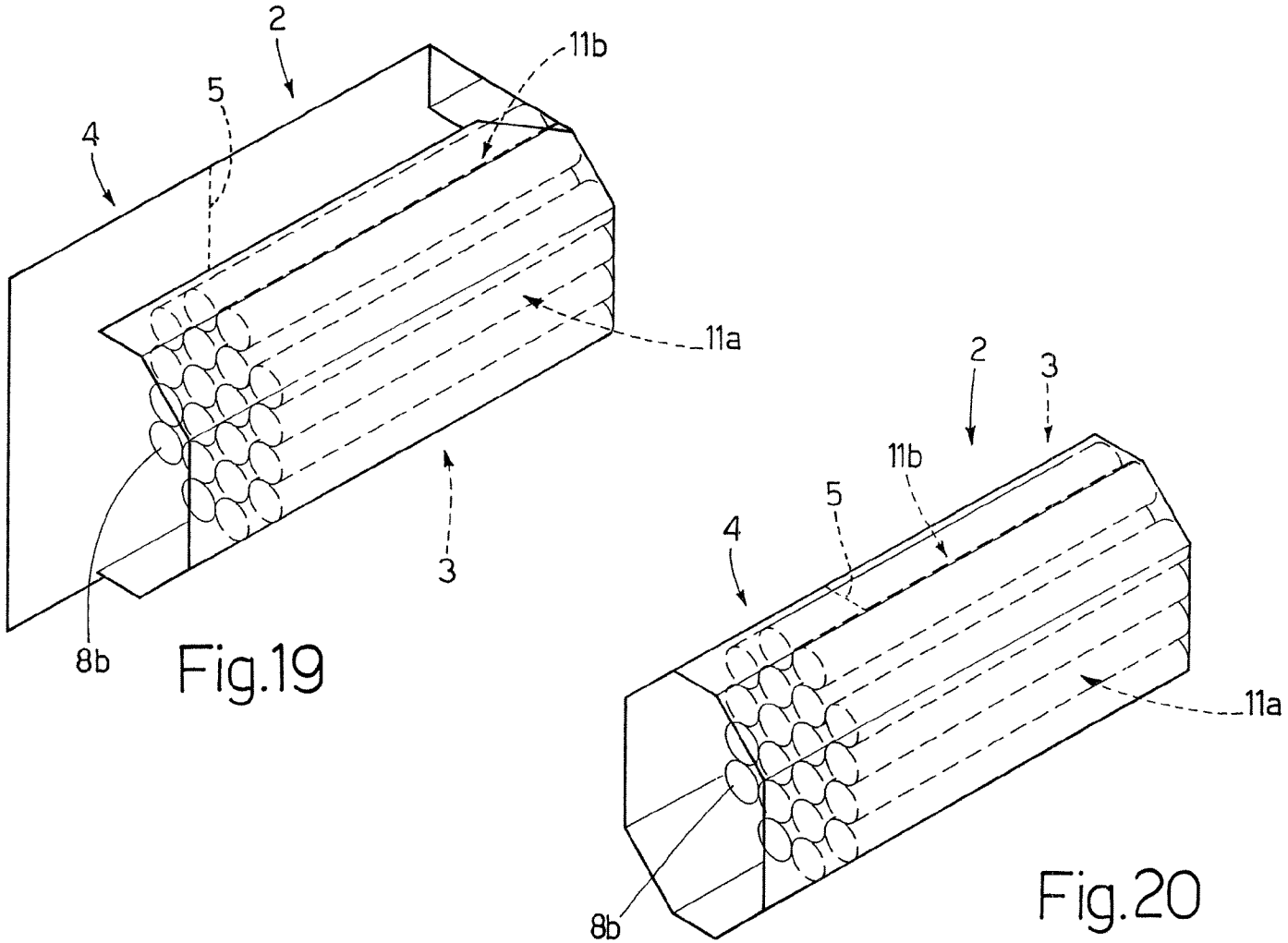

As shown in FIGS. 19 and 20, the four flaps of sheet 2 of packing material projecting from first lateral walls 11*a* of group 3 of cigarettes are folded in twos one on top of the other and onto second lateral walls 11*b* of group 3 of cigarettes to form a tubular package having one open end at a second end wall 8*b*.

Figure 21:
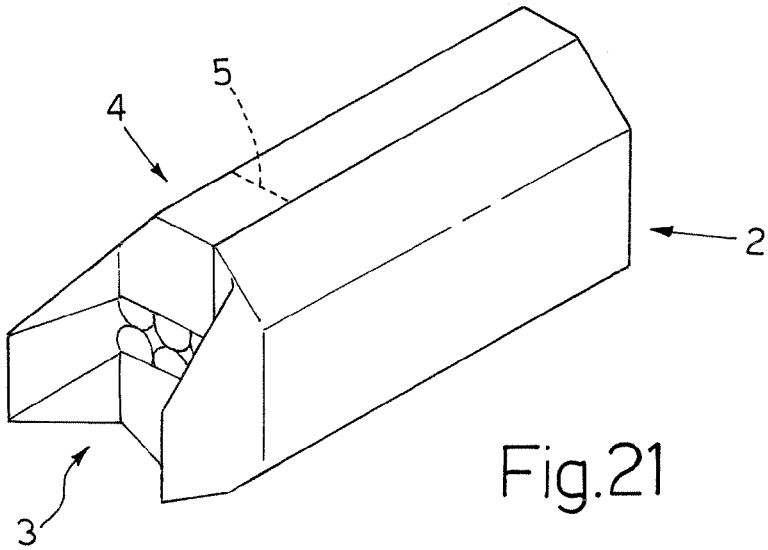

Finally, as shown in FIG. 21, sheet 2 of packing material is folded onto second end wall 8*b* to complete the folding of sheet 2 of packing material about group 3 of cigarettes and so form package 1. More specifically, the step of folding sheet 2 of packing material onto second end wall 8*b* comprises folding sheet 2 of packing material successively about four transverse edges of second end wall 8*b*.

Figure 29:
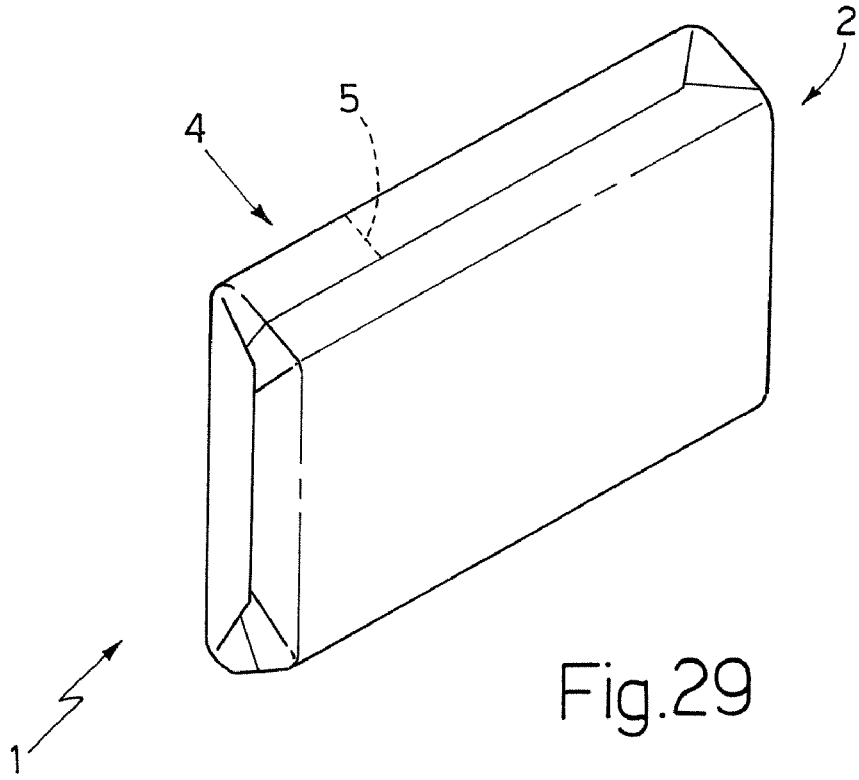
FIG. 29 shows a view in perspective of a fourth group of cigarettes wrapped in a fourth sheet of foil packing material folded using the method according to the present invention.

Number 1 in FIG. 29 indicates as a whole a package defined by a sheet 2 of foil packing material folded about an orderly group 3 of cigarettes (FIG. 23) in the form of a parallelepiped with an isosceles trapezoidal cross section. Package 1 comprises a tear-off top portion 4 defined by a tear-off line 5, and which, when package 1 is first opened, is torn off to permit easy access to group 3 of cigarettes.

Figure 23:
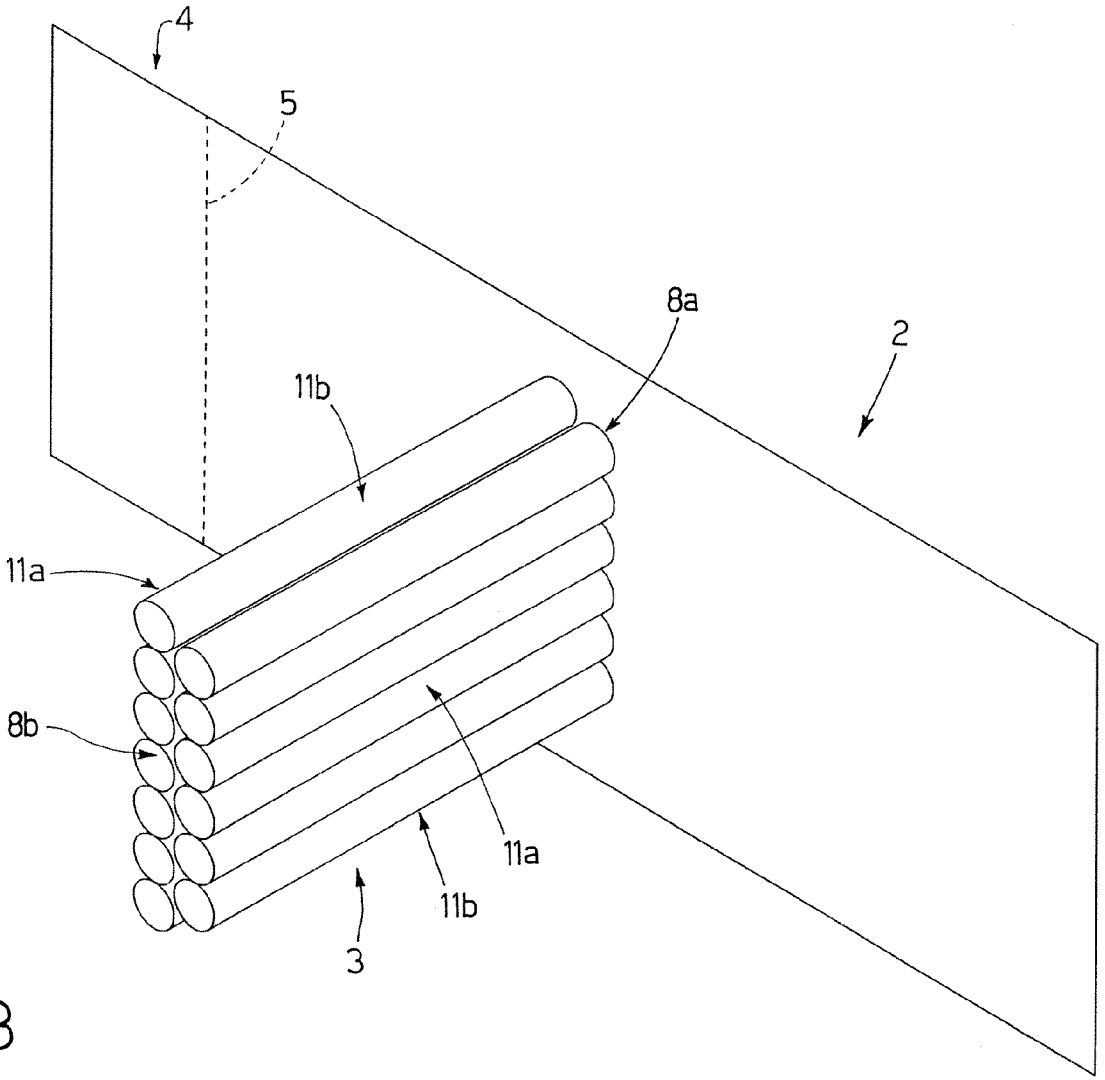
FIGS. 23-28 show schematic views in perspective of successive steps in the folding of the fourth sheet of foil packing material about the fourth group of cigarettes.

As shown in FIG. 23, sheet 2 of packing material is in the form of an elongated rectangle, and comprises two parallel opposite long sides, and two parallel opposite short sides.

As shown in FIG. 23, group 3 of cigarettes is substantially in the form of a parallelepiped with an isosceles trapezoidal cross section, and comprises four rectangular lateral walls 11 (only two shown in FIG. 23) defined by the cylindrical lateral walls of the cigarettes; and two parallel, opposite, trapezoidal end walls 8 (only one shown in FIG. 23) defined by the flat ends of the cigarettes. Four longitudinal edges are defined between the four lateral walls 11; and eight transverse edges are defined between the four lateral walls 11 and the two end walls 8. More specifically, two lateral walls 11*a* are parallel opposite major lateral walls, and two lateral walls 11*b* are minor lateral walls sloping towards each other and smaller than major lateral walls 11*a*.

The way in which sheet 2 of packing material is folded about group 3 of cigarettes to form package 1 in FIG. 29 will now be described with particular reference to FIGS. 23-28.

Firstly, as shown in FIG. 23, a first end wall 8*a* of group 3 of cigarettes is brought into contact with the flat sheet 2 of packing material, and is preferably positioned symmetrically in the centre of sheet 2 of packing material with respect to both the long sides and short sides of sheet 2 of packing material.

Figures 24, 25:
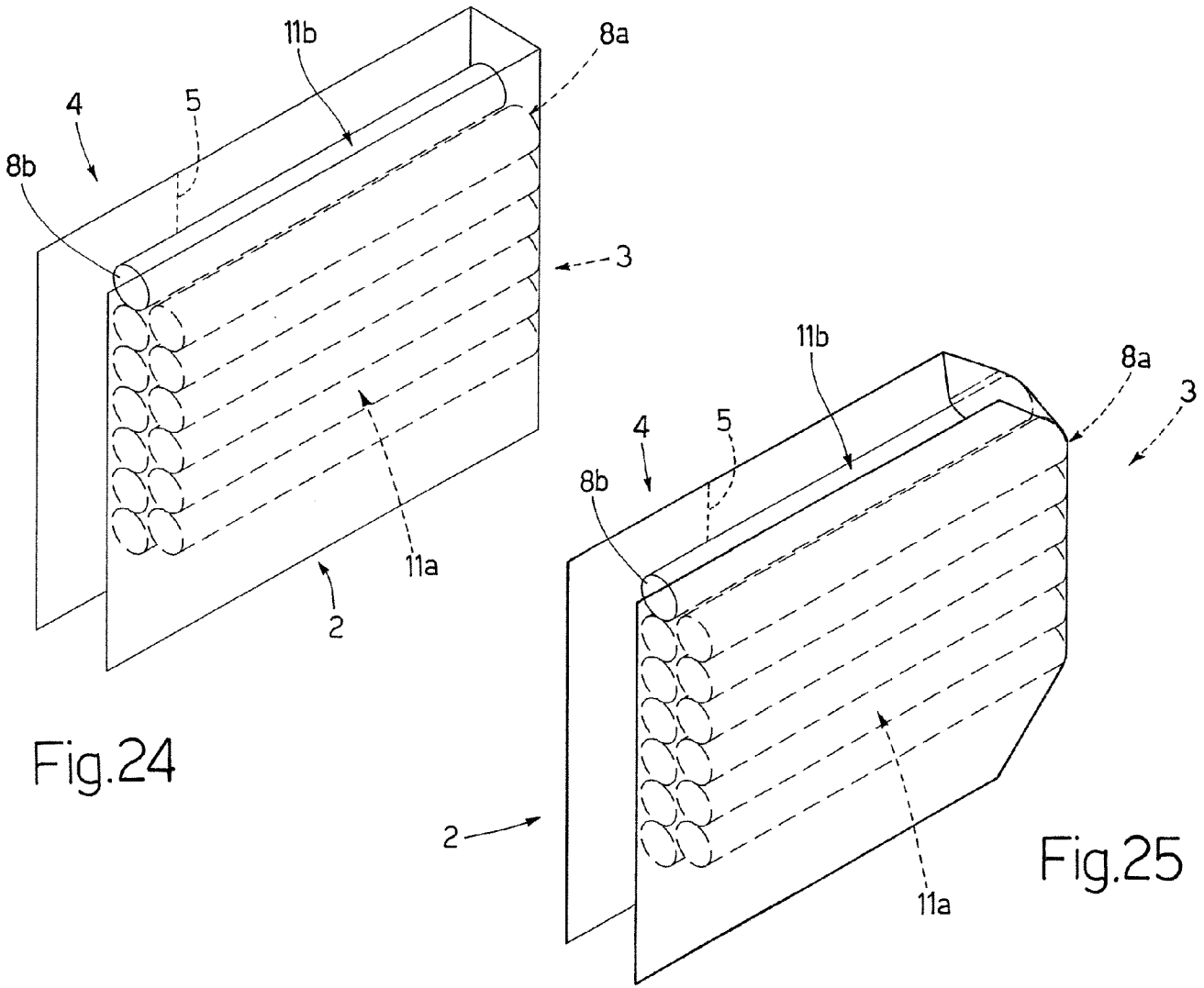

Next, as shown in FIG. 24, sheet 2 of packing material is folded into a U about group 3 of cigarettes by folding two opposite portions of sheet 2 of packing material onto two parallel opposite first lateral walls 11*a* of group 3 of cigarettes.

At this point, as shown in FIG. 25, the ends of sheet 2 of packing material projecting from first end wall 8*a* of group 3 of cigarettes are folded onto two opposite second lateral walls 11*b*, sloping with respect to first lateral walls 11*a*, of group 3 of cigarettes.

Figure 26:
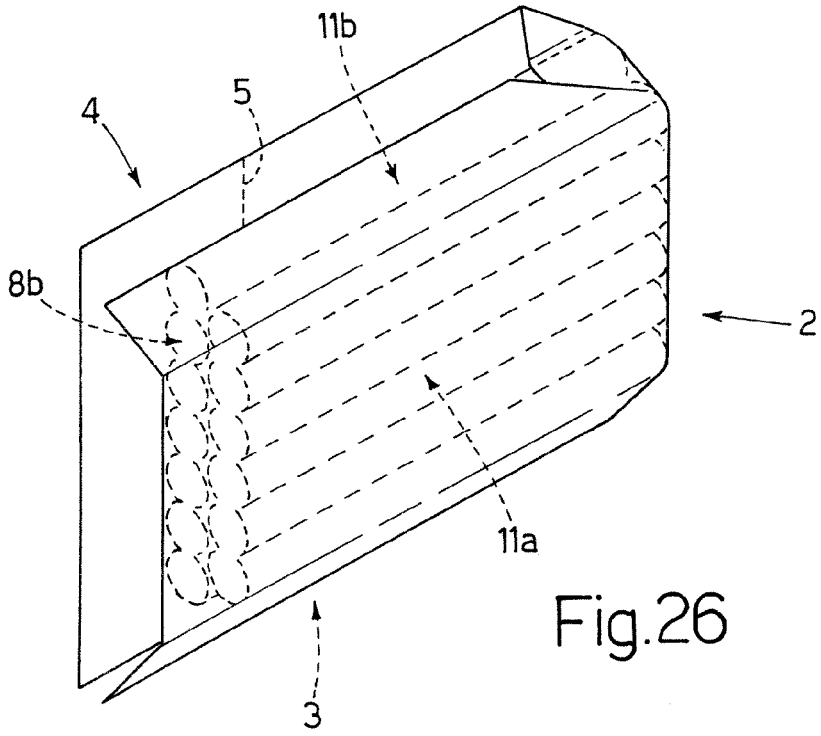
Figure 27:
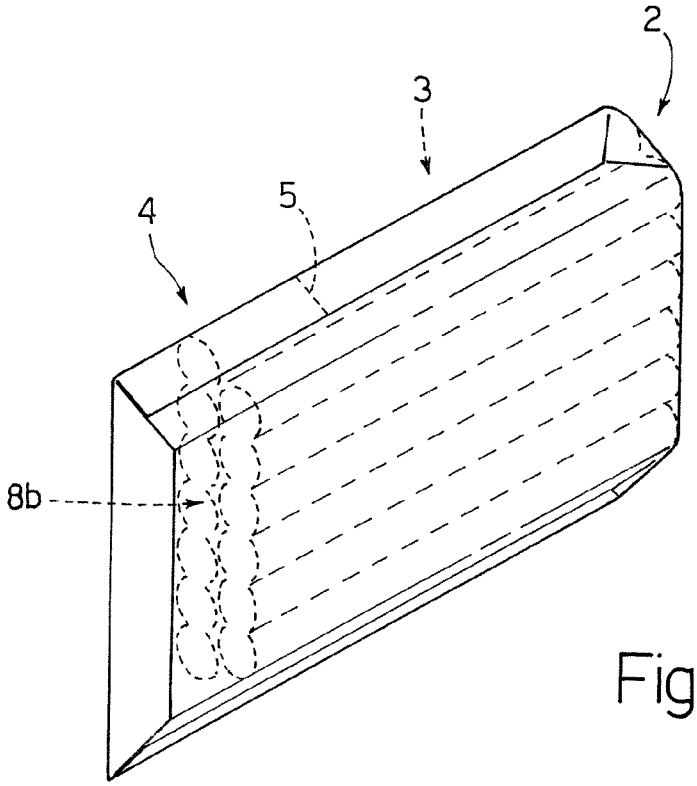

As shown in FIGS. 26 and 27, the four flaps of sheet 2 of packing material projecting from first lateral walls 11*a* of group 3 of cigarettes are folded in twos one on top of the other and onto second lateral walls 11*b* of group 3 of cigarettes to form a tubular package having one open end at a second end wall 8*b*.

Figure 28:
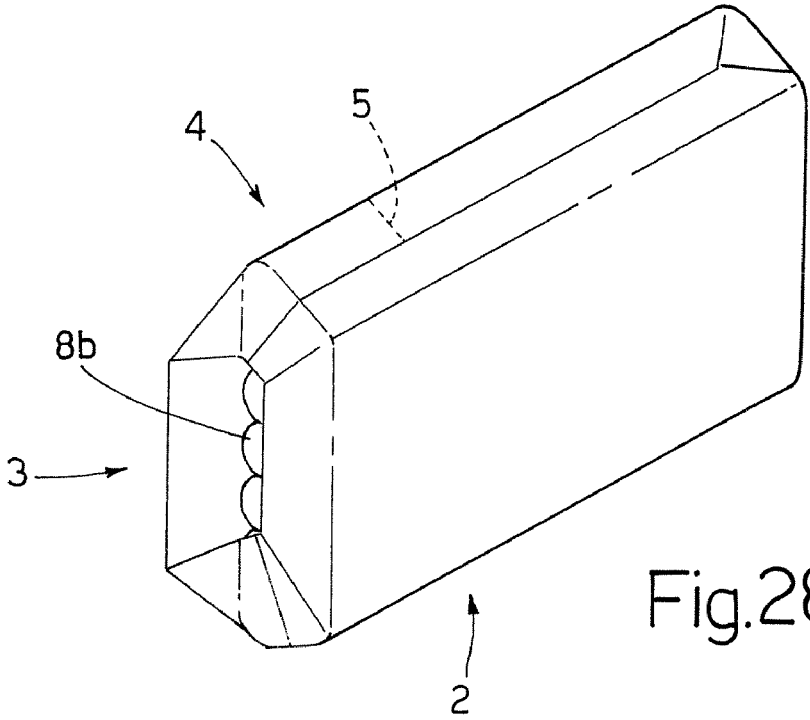

Finally, as shown in FIG. 28, sheet 2 of packing material is folded onto second end wall 8*b* to complete the folding of sheet 2 of packing material about group 3 of cigarettes and so form package 1. More specifically, the step of folding sheet 2 of packing material onto second end wall 8*b* comprises folding sheet 2 of packing material successively about the four transverse edges of second end wall 8*b*.

The method of folding sheet 2 of packing material about group 3 of cigarettes has several advantages: it is cheap and easy to implement on a packing machine and, above all, provides for straight tear-off lines 5, in the case of both a rigid packet with a hinged lid covering only a lateral portion of the rigid packet (FIGS. 1 and 2), and a rigid packet with a hinged lid covering the whole top portion of the rigid packet (FIGS. 9 and 10).

The invention claimed is:

1. A method of folding a sheet of packing material about a group of cigarettes;

the sheet (2) of packing material is in the form of an elongated rectangle, and comprises two parallel opposite long sides, and two parallel opposite short sides;

the group (3) of cigarettes is substantially parallelepiped-shaped with a rectangular cross section, and comprises two parallel opposite major lateral walls (6) defined by the cylindrical lateral walls of the cigarettes; two parallel opposite minor lateral walls (7) defined by the cylindrical lateral walls of the cigarettes and smaller than the major lateral walls (6); and two parallel opposite end walls (8) defined by the flat ends of the cigarettes; four longitudinal edges (9) are defined between the two major lateral walls (6) and the two minor lateral walls (7); four major transverse edges (10*a*) are defined between the two major lateral walls (6) and the two end walls (8); and four minor transverse edges (10*b*) are defined between the two minor lateral walls (7) and the two end walls (8);

and the method comprises the steps of:

bringing a first end wall (8*a*) of the group (3) of cigarettes into contact with the flat sheet (2) of packing material, so that the major transverse edges (10*a*) of the group (3) of cigarettes are parallel to the long sides of the sheet (2) of packing material, and the minor transverse edges (10*b*)

of the group (3) of cigarettes are parallel to the short sides of the sheet (2) of packing material;

folding the sheet (2) of packing material into a U about the major transverse edges (10*a*) of the first end wall (8*a*), so that the sheet (2) of packing material partly covers both the major lateral walls (6); and folding the sheet (2) of packing material about the minor transverse edges (10*b*) of the first end wall (8*a*), so that the sheet (2) of packing material completely covers both the major lateral walls (6) and the minor lateral walls (7), and forms a tubular package having one open end at a second end wall (8*b*).

2. A method as claimed in claim 1, and comprising the further step of folding the sheet (2) of packing material onto the second end wall (8*b*) to complete the folding of the sheet (2) of packing material about the group (3) of cigarettes.

3. A method as claimed in claim 2, wherein the step of folding the sheet (2) of packing material onto the second end wall (8*b*) comprises folding the sheet (2) of packing material about the two minor transverse edges (10*b*) of the second end wall (8*b*), and then folding the sheet (2) of packing material about the two major transverse edges (10*a*) of the second end wall (8*b*).

4. A method as claimed in claim 1, wherein the first end wall (8*a*) of the group (3) of cigarettes is positioned symmetrically in the centre of the sheet (2) of packing material with respect to both the long sides of the sheet (2) of packing material and the short sides of the sheet (2) of packing material.

5. A method as claimed in claim 1, and comprising the further step of forming on the sheet (2) of packing material a tear-off line (5), which is parallel and close to a short side of the sheet (2) of packing material, and defines a tear-off portion (4) of the sheet (2) of packing material.

6. A method as claimed in claim 1, and comprising the further step of forming on the sheet (2) of packing material two tear-off lines (5), each of which is parallel and close to a short side of the sheet (2) of packing material, and defines a tear-off portion (4) of the sheet (2) of packing material.

* * * * *